US005251694A

United States Patent [19]

Chigira

[11] Patent Number: 5,251,694

[45] Date of Patent: Oct. 12, 1993

[54] HEAT EXCHANGER

[75] Inventor: Hitoshi Chigira, Gunma, Japan

[73] Assignee: Sanden Corporation, Gunma, Japan

[21] Appl. No.: 724,905

[22] Filed: Jul. 2, 1991

[30] Foreign Application Priority Data

Jul. 2, 1990 [JP] Japan ..... 2-172648

[51] Int. Cl.[5] ..... F28F 9/02

[52] U.S. Cl. ..... 165/173; 165/153; 165/175; 29/890.052

[58] Field of Search ..... 165/173, 153, 175

[56] References Cited

U.S. PATENT DOCUMENTS 4,234,041 11/1980 Melnyk ..... 167/173

5,107,926 4/1992 Calleson ..... 165/153

FOREIGN PATENT DOCUMENTS 1961218 7/1970 Fed. Rep. of Germany ..... 165/153

*Primary Examiner*—Albert W. Davis, Jr.

*Attorney, Agent, or Firm*—Baker & Botts

[57] ABSTRACT

A heat exchanger having a pair of header pipes each of which includes a U-shaped wall and a front wall connected thereto to define a hollow portion. The front wall has a plurality of arc-shaped portions and plane portions each of which is disposed between adjacent arc-shaped portions in the longitudinal direction of the header pipe. Each of the plane portions are provided with an elongated hole therethrough. A plurality of fluid tubes are disposed between the header pipes in fluid communication therewith via the elongated holes. A plurality of corrugated fins are disposed between the opposed outer surfaces of the fluid tubes. Thus, the pressure loss of refrigerant in the heat exchanger is very low.

13 Claims, 7 Drawing Sheets

HEAT EXCHANGER

TECHNICAL FIELD

The present invention relates generally to heat exchangers, and more particularly, to a heat exchanger including header pipes each provided with an arc-shaped portion to reduce pressure loss.

BACKGROUND OF THE INVENTION

One prior art embodiment of a heat exchanger as described in Japanese Patent Application Publication No. 63-112065 is shown in FIGS. 1-3. As shown in the figures, condenser 50 includes a plurality of adjacent, essentially flat tubes 51 having an oval cross-section and open ends which allow refrigerant fluid to flow therethrough. A plurality of corrugated fin units 52 are disposed between adjacent tubes 51. Flat tubes 51 and fin units 52 jointly form heat exchange region 100. Cylindrical header pipes 53 and 54 are disposed perpendicular to flat tubes 51 and may have, for example, a clad construction. The diameter and length of header pipes 53 and 54 are substantially equal to the thickness and height, respectively, of heat exchange region 100. Accordingly, header pipes 53 and 54 protrude only negligibly relative to heat exchange region 100 when the heat exchanger structure is assembled.

As shown in FIG. 3, each of header pipes 53 and 54 includes outer tube 60 and inner tube 61. Outer tube 60 is preferably made of aluminum. Inner tube 61, made of a metal material, is brazed to the inner surface of outer tube 60. Outer tube 60 has a plurality of slots 62 disposed therethrough. Flat tubes 51 are fixedly connected to header pipes 53 and 54 and are disposed in slots 62 so that the open ends of flat tubes 51 communicate with the hollow interiors of header pipes 53 and 54. Inner tube 61 includes a plurality of portions 63 which define openings corresponding to slots 62. Portions 63 are brazed to the ends of flat tubes 51 and ensure that tubes 51 are hermetically sealed within header pipes 53 and 54 when the tubes are inserted in slots 62.

In operation, compressed refrigerant gas from an external compressor coupled to inlet union joint assembly 531 flows through the joint and into the upper cavity of header pipe 53. In header pipe 53, the refrigerant is distributed so that a portion of the gas flows through each of flat tubes 51 which is disposed above the location of partition wall 532, and into an upper portion of the upper cavity of header pipe 54. Thereafter, the refrigerant in the upper portion of the upper cavity of header pipe 54 flows downwardly into a lower portion of the upper cavity of header pipe 54. The refrigerant is distributed therein so that a portion of the refrigerant flows through each of flat tubes 51 disposed below the location of partition wall 532 and above the location of partition wall 542, and into an upper portion of the lower cavity of header pipe 53. The refrigerant in the upper portion of the lower cavity of header pipe 53 then flows downwardly into a lower portion of the lower cavity. At this point, the refrigerant is again distributed so that a portion of the refrigerant flows through each of flat tubes 51 disposed below the location of partition wall 542, and into the lower cavity of header pipe 54. As the refrigerant gas sequentially flows through flat tubes 51, heat from the refrigerant gas is exchanged with the atmospheric air flowing through corrugated fin units 52. The condensed liquid refrigerant in the lower cavity of header pipe 54 flows out of the cavity through outlet union joint assembly 541 and into an external receiver coupled to the joint assembly.

Another prior art embodiment of a heat exchanger as described in U.S. Pat. No. 4,615,385 is shown in FIG. 4. Each header pipe 53 and 54 has a plurality of slots 62 along one of its surfaces for receiving open ends of flat tubes 51. The surface portions of the header pipe between the slots 62 are shaped as outwardly extending convex domes 70 as shown in the FIG. 4.

In both of the above embodiments, open ends of flat tubes 51 extend considerably into the interiors of header pipes 53 and 54. Since the refrigerant introduced through inlet union joint assembly 531 flows in the longitudinal direction of header pipes 53 and 54, (i.e., perpendicular to flat tubes 51) the flow direction of the refrigerant has to turn suddenly to the open ends of flat tubes 51 to travel therethrough.

Accordingly, vortexes as shown by arrows A occur adjacent to the open ends of flat tubes 51. As a result, the pressure loss of the condenser is increased. In addition, according to the occurrence of vortexes, the flow speed of the refrigerant is reduced thereby necessitating the use of an excess volume of the refrigerant in the condenser.

SUMMARY OF THE INVENTION

It is a primary object of the present invention to provide a heat exchanger in which the pressure loss is very low.

It is another object of the present invention to provide a heat exchanger in which the flow volume of the refrigerant can be reduced.

It is still another object of the present invention to provide a heat exchanger in which the capacity to receive a high pressure refrigerant therein is improved.

It is still another object of the present invention to provide a heat exchanger in which the strength in resisting deformation can be improved.

A heat exchanger according to the present invention comprises a pair of header pipes each of which includes a U-shaped wall and a front wall connected thereto to define a hollow portion. The front wall has a plurality of integrally formed arc-shaped portions and plane portions. The plane portions are disposed between adjacent arc-shaped portions in the longitudinal direction of the header pipe. Each plane portion is provided with an elongated hole therethrough. A plurality of fluid tubes are disposed between the header pipes in fluid communication through the elongated holes. A plurality of corrugated fins are disposed between opposed outer surfaces of the fluid tubes.

Further objects, features and other aspects of this invention will be understood from the following detailed description of the preferred embodiment of this invention with reference to the annexed drawings.

BRIEF DESCRIPTION OF THE PREFERRED EMBODIMENTS

DETAILED DESCRIPTION OF THE PREFERRED EMBODIMENTS

Figure 1:
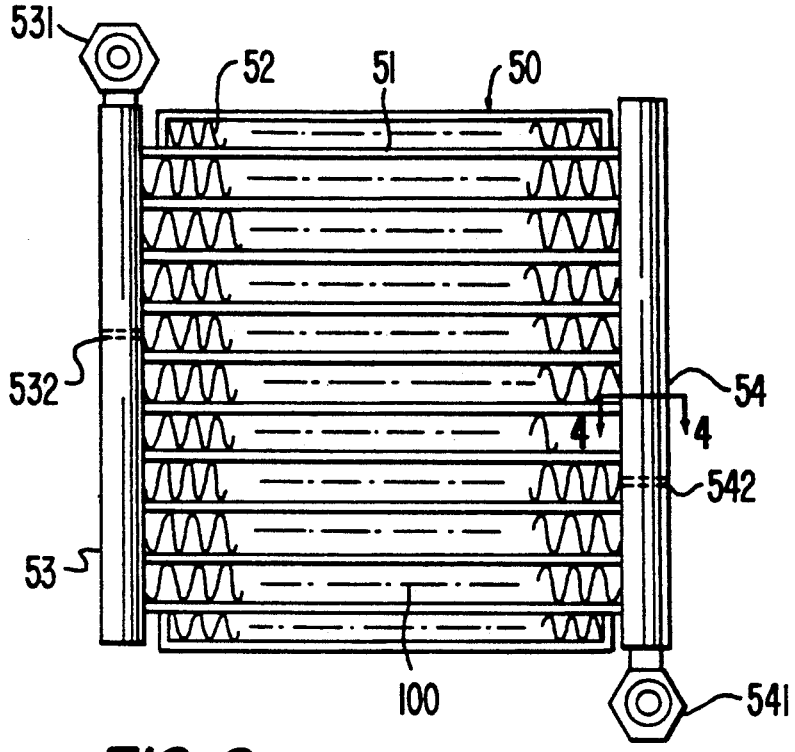
FIG. 1 (PRIOR ART)
FIG. 1 is an elevational view of a condenser in accordance with the prior art.
Figure 2:
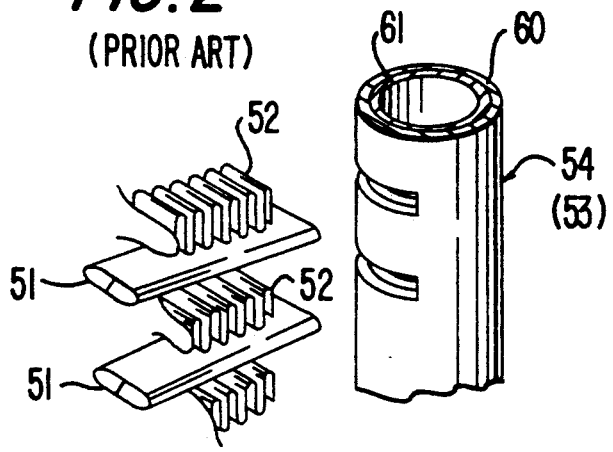
FIG. 2 (PRIOR ART)
FIG. 2 is a perspective view of certain elements of the condenser as shown in FIG. 1.
Figure 3:
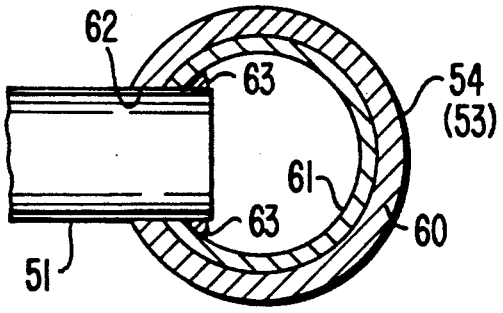
FIG. 3 (PRIOR ART)
FIG. 3 is a partial cross-sectional view taken along line 4—4 of FIG. 1.
Figure 4:
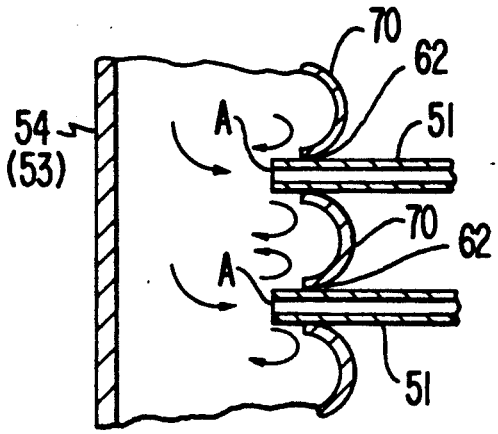
FIG. 4 (PRIOR ART)
FIG. 4 is a partial cross-sectional view of another prior art condenser.
Figure 5:
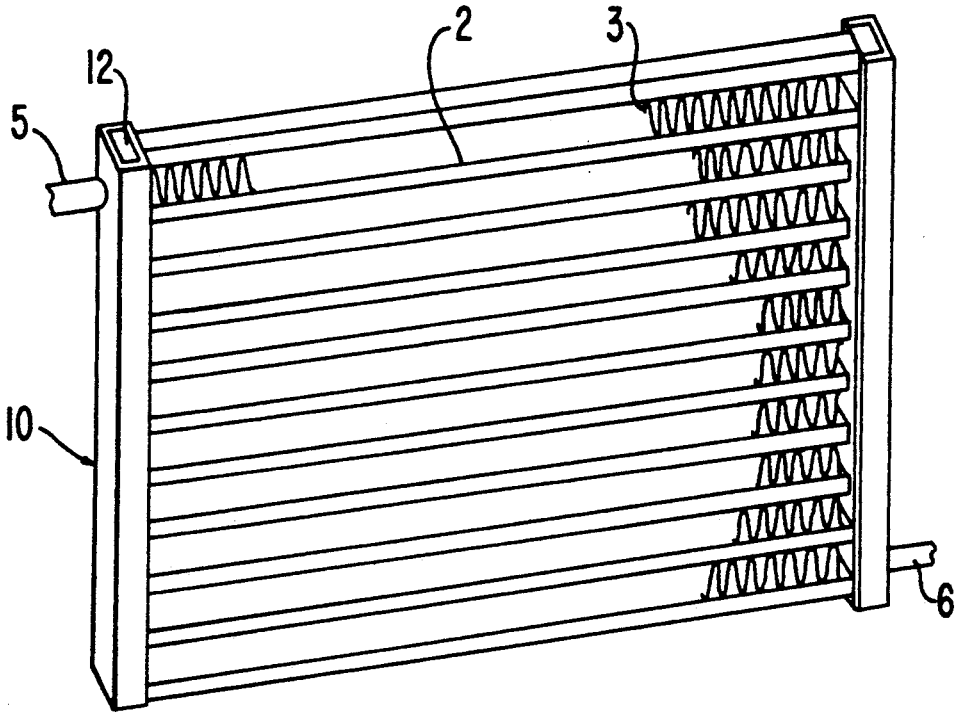
FIG. 5 is a perspective view of a condenser in accordance with one embodiment of this invention.
Figure 6:
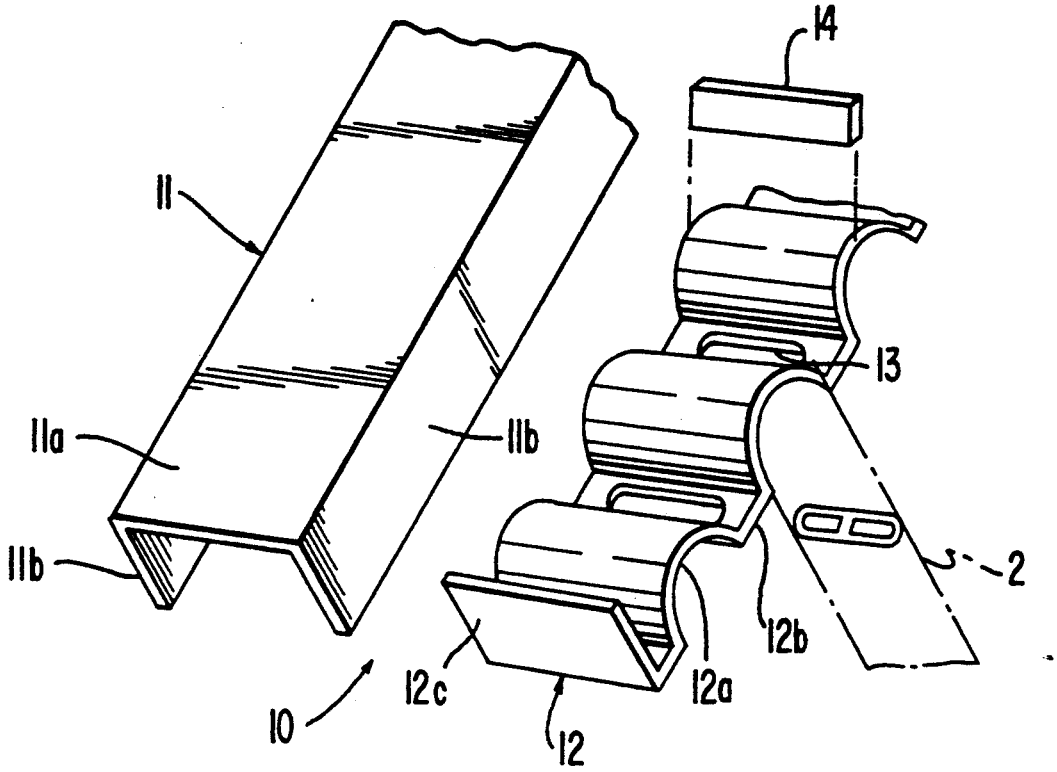
FIG. 6 is an exploded perspective view partially broken away of certain elements of the condenser as shown in FIG. 5.
Figure 7:
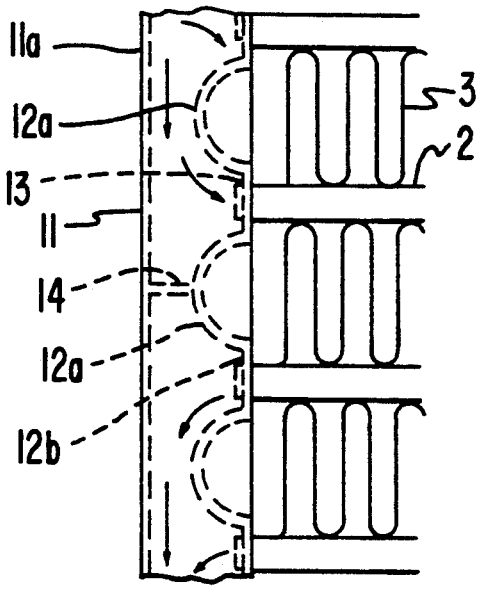
FIG. 7 is a partial cross-sectional view of a condenser as shown in FIG. 5.

The construction of a heat exchanger, and in particular a condenser, in accordance with the first embodiment of the present invention is shown in FIGS. 5–7.

A plurality of corrugated fin units 3 are disposed between adjacent tubes 2. Flat tubes 2 and fin units 3 jointly form the heat exchange region. Header pipes 10 are disposed perpendicular to flat tubes 2 and may have, for example, a clad construction. Each part of the condenser in the other embodiments discussed herein is made of the same materials as described in regard to this embodiment. Header pipe 10 includes U-shaped wall 11 and front wall 12. U-shaped wall 11 is preferably formed by bending an aluminum plate into a U-shaped and clading brazing materials on both surfaces thereof. As bent, the plate defines rear plate portion 11*a* and side plate portions 11*b*. Front wall 12 is preferably formed by bending the same type of aluminum plate as U-shaped wall 11 to define a plurality of arc-shaped portions 12*a*, plate portions 12*b* disposed between adjacent arc-shaped portions 12*a*, and edge portions 12*c* at both ends thereof. Plate portions 12*b* are formed integrally with arc-shaped portions 12*a* and edge portions 12*c*. Further, each plate portion 12*b* is provided with elongated hole 13 to receive an open end of flat tube 2. The outer width of front wall 12 corresponds to the width between the inner surfaces of side plate portions 11*b* of U-shaped wall 11. The height of edge portions 12*c* of front wall 12 corresponds to the depth of U-shaped wall 11. The height of arc-shaped portions 12*a* is lower than the depth of U-shaped wall 11 to thereby define a certain gap between the top surfaces of arc-shaped portions 12*a* and the inner surface of rear plate portion 11*a*. Partition wall 14 is disposed in the gap and connects arc-shaped portion 12*a* with the inner surface of rear plate portion 11*a*. The contact surfaces between front wall 12 and U-shaped wall 11 including partition walls 14 are preferably fixed by brazing.

In operation, compressed refrigerant gas from an external compressor coupled to inlet tube 5 flows into the interior of header pipe 10 through inlet tube 5. The refrigerant is distributed so that a portion of the gas adjacent rear plate portion 11*a* flows directly along the plane surface of rear plate portion 11*a* and another portion of the gas adjacent front wall 12 flows toward the open end of flat tube 2 along the curved surface of arc-shaped portion 12*a*, as shown by arrows in FIG. 7. The gas which flows out of the open end of flat tube 2 also flows toward the flat surface of rear plate portion 11*a* along the curved surface of arc-shaped portion 12*a*.

Since the refrigerant gas flows along the curved surfaces of arc-shaped portion 12*a* as described above (i.e., the direction of the flow of the refrigerant gas adjacent the open end of flat tube 2 is similar to that of the refrigerant gas in flat tube 2) the occurrence of vortexes adjacent the open end of flat tube 2 is reduced. As a result, the pressure loss of the refrigerant in the heat exchanger is also decreased.

Figure 8:
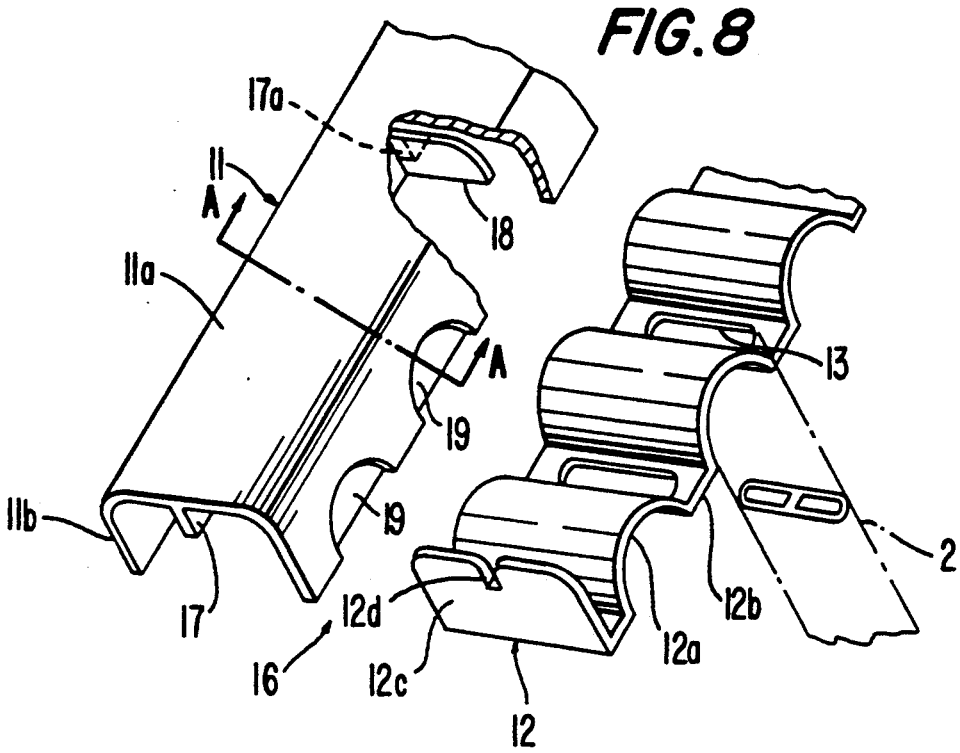
FIG. 8 is an exploded perspective view partially broken away of certain elements of the condenser in accordance with another embodiment of this invention.
Figure 10:
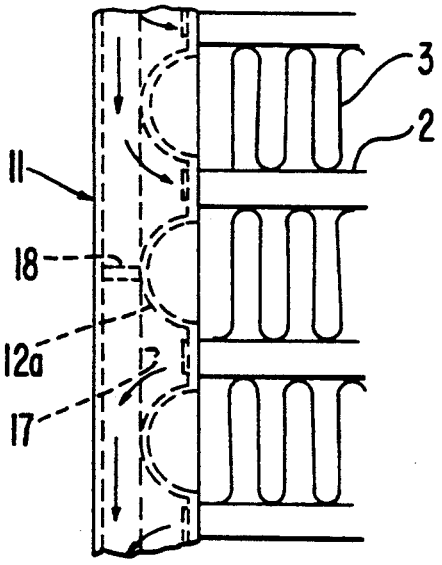
FIG. 10 is a partial side view of a condenser including certain elements as shown in FIG. 8.
Figure 9:
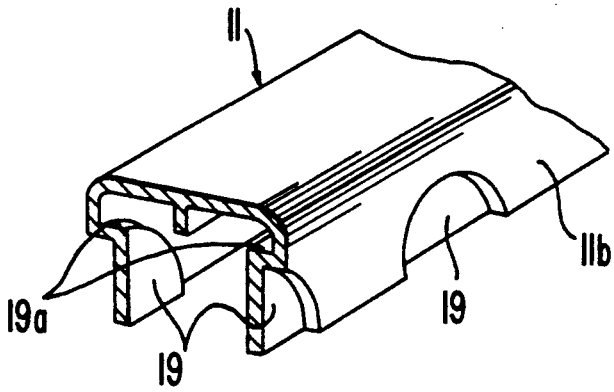
FIG. 9 is a partially cut away perspective view taken along line A—A of FIG. 8.

The construction of a part of a condenser in accordance with a second embodiment of the present invention is shown in FIGS. 8–10. Header pipe 16 includes U-shaped wall 11 and front wall 12. U-shaped wall 11 has rear plate portion 11*a*, side plate portions 11*b* and projecting portion 17 extending in the longitudinal direction thereof at its inner end surface. Projecting portion 17 has cut portions 17*a* spaced out in the longitudinal direction of U-shaped wall 11. Partition walls 18 are respectively fitted into cut portions 17*a*. Front wall 12 has a plurality of arc-shaped portions 12*a*, plate portions 12*b* disposed between each arc-shaped portions 12*a*, edge portions 12*c* at both ends thereof, and cut portions 12*d* formed at the top ends of edge portions 12*c*. U-shaped wall 11 also has a plurality of step-like portions 19 spaced out along both side plate portions 11*b* in the longitudinal direction thereof at the positions corresponding to arc-shaped portions 12*a* of front wall 12. Step-like portions 19 are preferably formed by an embossing process so that inner peripheral surfaces 19*a* of step-like portions 19 contact the outer peripheral surfaces of arc-shaped portions 12*a* along both of its sides, respectively, and project inwardly of U-shaped wall 11 as shown in FIG. 9.

In the preferred assembly of header pipes 16, the top ends of both side plate portions 11*b* are first enlarged. Front wall 12 is then inserted into the interior of U-shaped wall 11 until the top end surfaces of arc-shaped portions 12*a* contact the outer end surface of projecting portion 17 and projecting portion 17 is fit into cut portions 12*d* of front wall 12. Thereafter, the heat exchanger including header pipes 16 is made by brazing the parts together.

In the above construction, several parts are brazed together. Specifically, the end surface of projecting portion 17 is brazed to the top end surfaces of arc-shaped portions 12*a*. Further, the outer peripheral surfaces of arc-shaped portions 12*a* are brazed to inner peripheral surfaces 19*a* of step-like portions 19. This construction enhances the strength of header pipe 16 and improves its capacity to receive a high pressure gas therein.

Figure 11:
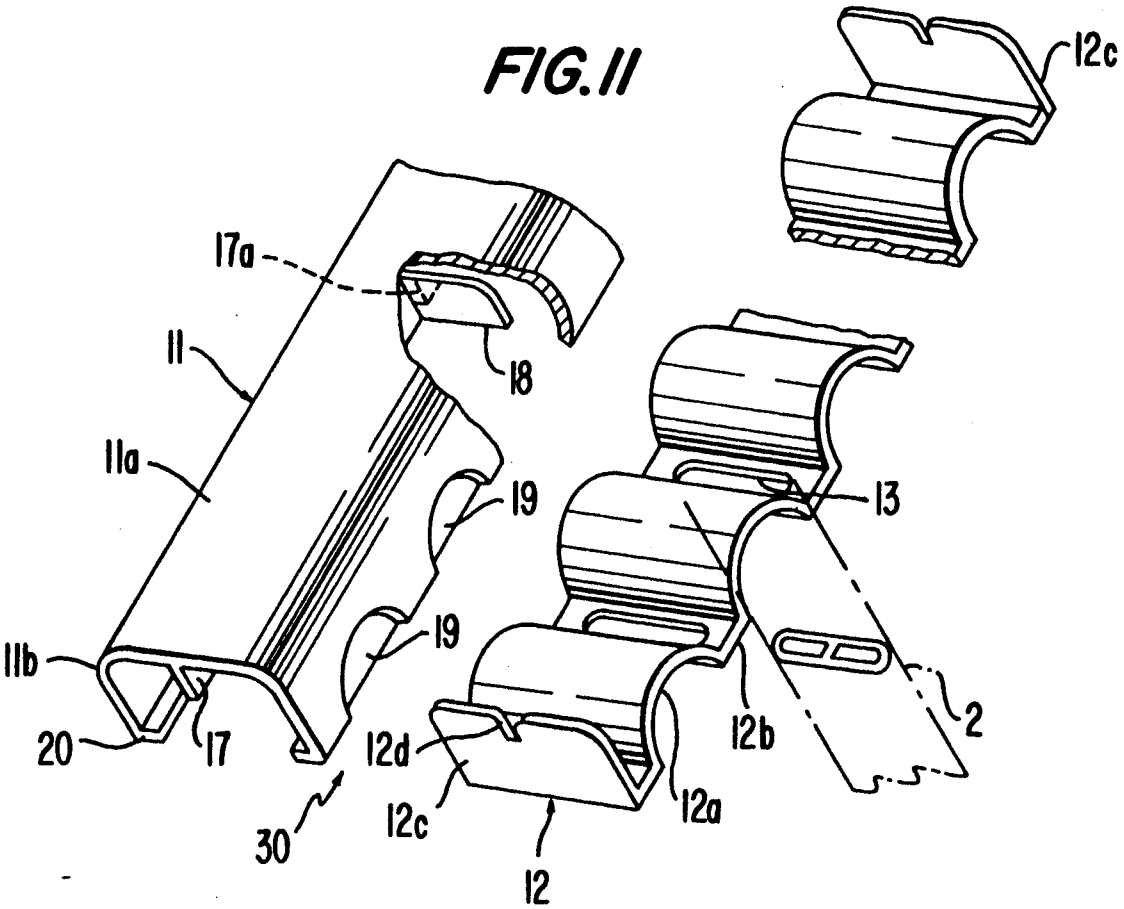
FIG. 11 is an exploded perspective view partially broken away of certain elements of the condenser in accordance with still another embodiment of this invention.

The construction of a part of a condenser in accordance with a third embodiment of the present invention is shown in FIG. 11. Header pipe 30 includes U-shaped wall 11 and front wall 12. U-shaped wall 11 includes all the elements of the second embodiment as well as ribs 20 extending inwardly and in the longitudinal direction of U-shaped wall 11 from the ends of side plate portions 11*b*. The gap between the end surface of projecting portion 17 and the inner surface of rib 20 is the same as the height of arc-shaped portions 12*a* to enable the insertion of arc-shaped portions 12*a*. Front wall 12 has the same portions as described in the second embodiment. In addition, one of both edge portions 12*c* is formed separately from front wall 12. After front wall 12 is fitted into U-shaped wall 11, the edge portion 12*c* is fixed to the end of front wall 12.

In the preferred assembly of header pipes 30, front wall 12 is fitted between the inner surfaces of ribs 20 and the end surface of projecting portion 17 through one end thereof which has no edge portion 12*c*. Edge portion 12*c* is then fixed to the end of front wall 12. Thereafter, the heat exchanger including header pipes 16, is made by brazing the parts together.

In the above construction, front wall 12 is easily positioned between ribs 20 and projecting portion 17. As a result, the assembly is easily accomplished. The strength of header pipe 30 is also reinforced.

Figure 12:
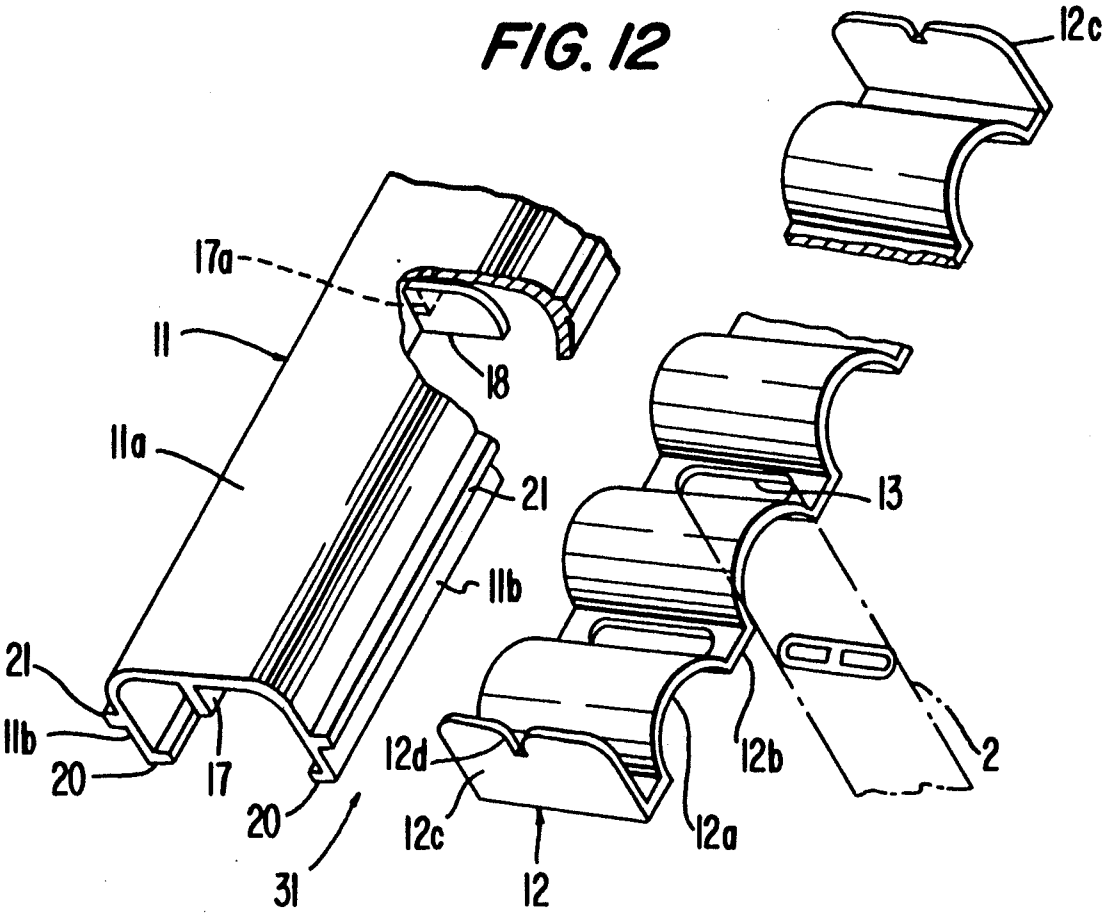
FIG. 12 is an exploded perspective view partially broken away of certain elements of the condenser in accordance with still another embodiment of this invention.

The construction of a part of a condenser in accordance with a fourth embodiment of the present invention is shown in FIG. 12. Header pipe 31 includes U-shaped wall 11 and front wall 12. U-shaped wall 11 includes all the elements of the third embodiment as well as reinforcing ribs 21, excluding step-like portions 19. Ribs 21 extend outwardly and in the longitudinal direction of U-shaped wall 11 from the sides of side plate portions 11*b*. In the above construction, U-shaped wall 11 has reinforcing ribs 21 extending outwardly and in the longitudinal direction of U-shaped wall 11 from both side surfaces of side plate portions 11*b*. This construction further improves the strength of header pipe 31.

Figure 13:
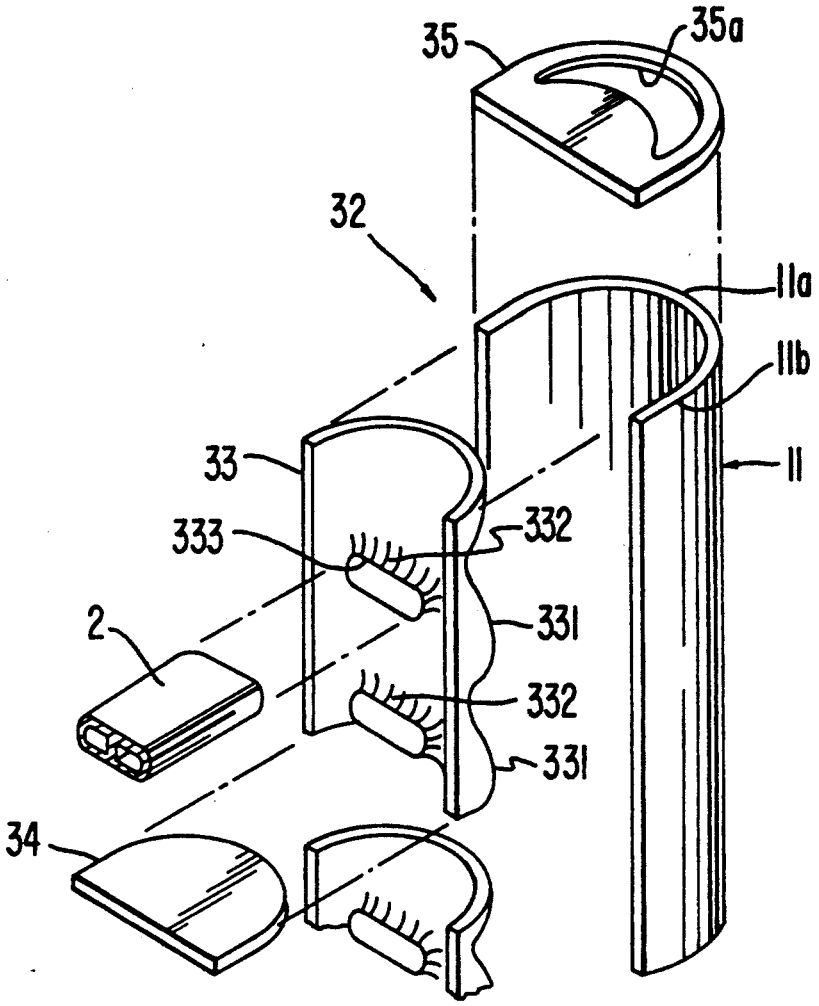
FIG. 13 is an exploded perspective view of certain elements of the condenser in accordance with still another embodiment of this invention.
Figure 14:
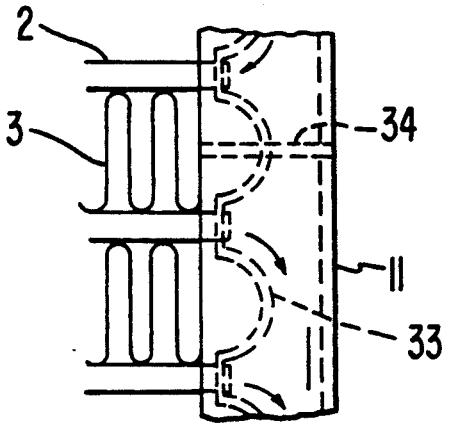
FIG. 14 is a partial side view of a condenser including certain elements as shown in FIG. 13.

The construction of a part of a condenser in accordance with a fifth embodiment of the present invention is shown in FIGS. 13 and 14. Header pipe 32 includes U-shaped wall 11 and a plurality of front walls segments 12. U-shaped wall 11 has rear plate portion 11*a* and side plate portions 11*b* which are integrally formed by bending an aluminum plate into a U-shape with an arcuate configuration. Each front wall segment 33 has a plurality of convex portions 331 projecting toward rear plate portion 11*a* and concave portions 332 disposed between convex portions 331. Elongated holes 333 are formed on the peaks of the concave portions 332, to enable the insertion of the open ends of flat tubes 2 therein. Front wall segments 33 are formed so that both of the side surfaces of front walls 33 can sealingly contact the inner side surfaces of the side plate portions 11*b*. A plurality of partition walls 34 are disposed between front wall segments 33 to define the flow of the refrigerant. End plates 35 include step-like portions 35*a* extending toward the interior of header pipe 32 and engaging the inner surface of rear plate portion 11*a* and convex portions 331. The end plates are fitted into the top and bottom ends of header pipe 32 to sealingly close the interior thereof.

In the above construction, front wall 33 and U-shaped wall 11 are connected at both side surfaces. The construction enhances the strength of header pipe 31 to increase the capacity for higher inner pressures and decrease the risk of deformation.

The present invention has been described in accordance with preferred embodiments. These embodiments, however, are merely for example only, and the invention should not be construed as limited thereto. It should be apparent to those skilled in the art that other variations or modifications can be made within the scope of this invention.

I claim:

1. A heat exchanger comprising:

a pair of header pipes each including a U-shaped wall and a front wall connected thereto to define a hollow portion, said front wall having a plurality of arc-shaped portions and plane portions disposed between said arc-shaped portions in the longitudinal direction of said header pipes, said arc-shaped portions extending toward said U-shaped wall, each of said plane portions being provided with an elongated hole therethrough;

a plurality of fluid tubes disposed between said header pipes in fluid communication therewith via said elongated holes; and a plurality of corrugated fins disposed between opposed outer surfaces of said fluid tubes.

2. The heat exchanger of claim 1 wherein said U-shaped wall has a plurality of partition walls extending from the inner surface of said U-shaped wall to the top end surface of at least one of said arc-shaped portion to partition said hollow portion.

3. The heat exchanger of claim 2 wherein said U-shaped wall has a rear plate portion and a pair of side plate portions.

4. The heat exchanger of claim 3 wherein said front wall further comprises edge portions, said edge portions having cut portions therein, wherein said rear plate portion has a projecting portion extending in the longitudinal direction of said header pipe along its inner surface, and wherein said projecting portion is fit into each cut portion formed in said edge portions.

5. The heat exchanger of claim 4 wherein each of said side plate portions has a rib portion extending inwardly and in the longitudinal direction of said header pipe.

6. The heat exchanger of claim 4 wherein said side plate portions have step-like portions spaced out at positions corresponding to said arc-shaped portions.

7. The heat exchanger of claim 4 wherein each of said side plate portions has a rib portion extending outwardly and in the longitudinal direction of said header pipe.

8. A heat exchanger comprising:

a first header pipe;

a second header pipe comprising a U-shaped wall and a front wall connected thereto to define a hollow portion, said front wall having a plurality of arc-shaped portions and plane portions disposed between said arc-shaped portions in the longitudinal direction of said header pipes, said arc-shaped portions extending toward said U-shaped wall, each of said plane portions being provided with an elongate hole therethrough;

a plurality of fluid tubes disposed between said header pipes in fluid communication therewith via said elongated holes; and a plurality of corrugated fins disposed between opposed outer surfaces of said fluid tubes.

9. The heat exchanger of claim 8, said first header pipe comprising a U-shaped wall and front wall connected thereto to define a hollow portion, said front wall having a plurality of arc-shaped portions, said arc-shaped portions extending toward said U-shaped wall, each of said arc-shaped portions being provided with an elongate hole therethrough.

10. A heat exchanger comprising:

a first header pipe including a plurality of elongate holes;

a second header pipe comprising a U-shaped wall and a front wall connected thereto to define a hollow portion, said front wall comprising a plurality of arc-shaped portions and a plurality of elongate holes, said arc-shaped portions extending toward said U-shaped wall;

a plurality of fluid tubes disposed between said header pipes in fluid communication therewith via said elongate holes; and a plurality of corrugated fin disposed between opposed outer surfaces of said fluid tubes.

11. The heat exchanger of claim 10, further comprising a plurality of plane portions disposed between said arc-shaped portions, said elongate holes being provided in said plane portions.

12. The heat exchanger of claim 10, said first header pipe comprising a U-shaped wall and a front wall connected thereto to define a hollow portion, said front wall comprising a plurality of arc-shaped portions and a plurality of elongate holes, said arc-shaped portions extending toward said U-shaped wall.

13. The heat exchanger of claim 12, further comprising a plurality of plane portions disposed between said arc-shaped portions of at least one of said first and second header pipes, said elongate holes being provided in said plane portions.

* * * * *